United States Patent [19]

Vandebult

[11] Patent Number: 4,527,310

[45] Date of Patent: Jul. 9, 1985

[54] SECURE RELEASE APPARATUS FOR ANTI-THEFT FASTENING DEVICE

[75] Inventor: Jan Vandebult, Topsfield, Mass.

[73] Assignee: I. D. Engineering, Inc., Ipswich, Mass.

[21] Appl. No.: 516,329

[22] Filed: Jul. 22, 1983

[51] Int. Cl.[3] ..... B65D 55/10; H01F 3/12

[52] U.S. Cl. ..... 24/150 R; 24/136 R; 24/155 BR; 24/303; 40/20 R; 70/159; 361/142; 361/160

[58] Field of Search ..... 24/150 R, 155 BR, 562, 24/136 R, 136 L, 30.5 R, 303; 40/20 R; 361/160, 142; 292/252, 307, 316; 70/159, 160

[56] References Cited

U.S. PATENT DOCUMENTS

| | | | |
|---|---|---|---|
| 1,005,445 | 10/1911 | Maib et al. | 361/142 |
| 1,311,040 | 7/1919 | Burton | 24/30.5 R |
| 2,117,615 | 7/1936 | Krogh . | |
| 3,343,384 | 8/1965 | Barr . | |
| 3,628,267 | 12/1971 | Minasy | 40/20 R |
| 3,947,930 | 4/1976 | Martens et al. | 40/20 R |
| 3,974,581 | 8/1976 | Martens et al. | 40/20 R |
| 4,012,813 | 3/1977 | Martens et al. | 361/160 |
| 4,221,025 | 9/1980 | Martens et al. | 24/150 R |
| 4,339,853 | 7/1982 | Lipschitz | 24/136 R |

FOREIGN PATENT DOCUMENTS

| | | | |
|---|---|---|---|
| 426072 | 3/1935 | United Kingdom | 40/20 R |

*Primary Examiner*—Victor N. Sakran

*Attorney, Agent, or Firm*—Schwartz, Jeffery, Schwaab, Mack, Blumenthal & Evans

[57] ABSTRACT

The secure release apparatus is used with an anti-theft device having a member which is movable in response to an applied magnetic field. The secure release apparatus comprises a cover plate with an access opening and a permanent magnet structure which produces a concentrated magnetic field sufficiently strong to move the member. A tamper prevention structure is movable into a first position for preventing the member from moving into the concentrated field.

11 Claims, 8 Drawing Figures

SECURE RELEASE APPARATUS FOR ANTI-THEFT FASTENING DEVICE

BACKGROUND OF THE INVENTION

1. Field of the Invention

The present invention relates to a tool for releasing a fastening device which can be attached to an article or articles in such a manner that the device can be separated only by use of the tool located, for example, at a checkout point in a department store or the like. In particular, the present invention relates to such a tool which can easily be secured against use by non-authorized personnel.

2. Discussion of Related Art

Identification tags are known which contain electric circuits. These tags can be secured to clothing or other articles on sale in a department store to act as anti-theft monitors. Special receiving equipment is positioned at the exits of the store and is activated when one attempts to remove a garment with an attached tag.

The tag assembly is temporarily attached to an article prior to authorized handling and sale of such article, at which time, the identification tag is removed. Fastening devices which can be used to effect this type of attachment are well known and an example of such is described in U.S. Pat. No. 3,974,581 to Martens et al. The Martens et al fastener operates by inserting a pin into a lock assembly. The pin cannot be removed until the lock assembly is subjected to a magnetic field. The magnetic field causes displacement of a locking apparatus within the lock assembly which releases the pin.

Various tools are known for producing a magnetic field which is capable of releasing such a lock assembly. For example, U.S. Pat. No. 4,012,813 to Martens et al shows a release tool which incorporates an electromagnet for producing the desired magnetic field. The Martens et al device is quite effective for its intended purpose but has the drawback that an electrical power source must be available in order to actuate the release device. On the other hand, this type of release device can be rendered secure by simply disconnecting the power source when the device is not in use.

Another type of release tool is shown in U.S. Pat. No. 4,339,853 to Lipschitz. The Lipschitz device incorporates plural permanent magnets oriented to produce an intensified magnetic field. This intensified magnetic field acts on the locking apparatus of the fastening device. Tools using permanent magnets are quite effective and convenient; however, they suffer from a common defect that it is relatively difficult to render these devices secure since the magnetic field cannot be turned off. At the present time, in order to ensure that unauthorized personnel do not remove security tags by use of an unattended release tool, these tools are provided in portable housings which are capable of being stored in a locked cabinet or the like when not in use. This solution to the problem of security can be quite cumbersome when a lockable cabinet is not readily available in a location convenient to a checkout counter or other place where the tags are to be removed.

SUMMARY OF THE INVENTION

A primary object of the present invention is to provide a release apparatus for a magnetically releasable anti-theft tag which apparatus can be stored at the point of use and rendered secure against tampering when not in use.

Another object of the present invention is to provide a secure release apparatus for use with an anti-theft device which apparatus can actually be built into a countertop at its point of use so as to be readily available yet mounted in a manner which does not form an obstruction.

A still further object of the present invention is to provide a secure release apparatus for an anti-theft tag which is relatively simple in construction yet highly durable in use, thereby permitting repeated reuse of the apparatus.

Yet another object of the present invention is to provide a secure release apparatus for use with an anti-theft tag which contains a security feature that can be easily moved into position to protect the tool against unauthorized use and can be locked in the operative position.

In accordance with the above and other objects, the present invention is a secure release apparatus for use with an anti-theft device wherein the anti-theft device comprises a main body having a bore, a pin sized to fit within the bore, a gripping structure in the main body for engaging and holding the pin, and a disengagement apparatus for disengaging the gripping structure. The disengagement apparatus includes a member which is movable in response to an applied magnetic field. The secure release apparatus comprises a housing with a cover plate wherein an access opening is formed within the cover plate for receiving the main body. A permanent magnet structure is contained in the housing and produces a concentrated magnetic field sufficiently strong to move the disengagement member when the main body is received in the access opening and the disengagement member is disposed in the concentrated magnetic field. A tamper prevention structure is provided which is movable into a position for preventing the disengagement member from being moved into the concentrated field.

In accordance with other aspects of the invention, the tamper prevention structure is contained within the housing and a lock is included which is accessible from outside of the housing for locking the tamper prevention structure in position.

In one embodiment, the tamper prevention structure comprises a plate element and means for moving the plate element across one side of the access opening.

In another embodiment, the tamper prevention structure comprises a means for moving the permanent magnet toward and away from the access opening. In one case, this means moves the permanent magnet laterally relative to the access opening and in another case, the means moves the magnet axially to a position from the access opening greater than the depth of the main body.

In accordance with other aspects of the invention, the permanent magnet structure comprises an annular shaped magnet having a central opening aligned with the access opening, a disk shaped magnet received in a central opening of the annular shaped magnet, and a ferromagnetic plate mounting the two magnets.

BRIEF DESCRIPTION OF THE DRAWINGS

The above and other objects of the present invention will become more readily apparent as the invention is more clearly understood from the following detailed description, reference being had to the accompanying drawings in which like reference numerals represent like parts throughout, and in which.

DETAILED DESCRIPTION OF THE PREFERRED EMBODIMENTS

Figure 1:
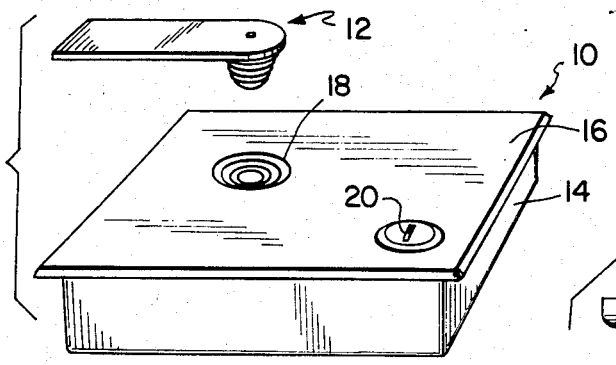
FIG. 1 is a perspective view of a secure release apparatus of the present invention and an anti-theft tag having a fastening clip to be opened by the release apparatus.

FIG. 1 shows the release apparatus 10 and an anti-theft tag 12. Release apparatus 10 comprises a housing having a base 14 and a top plate 16. A beveled opening 18 is formed centrally in the top plate. A key slot 20 is also present in the top plate 16 so that a key can be used to lock or unlock the release apparatus 10.

Figure 2:
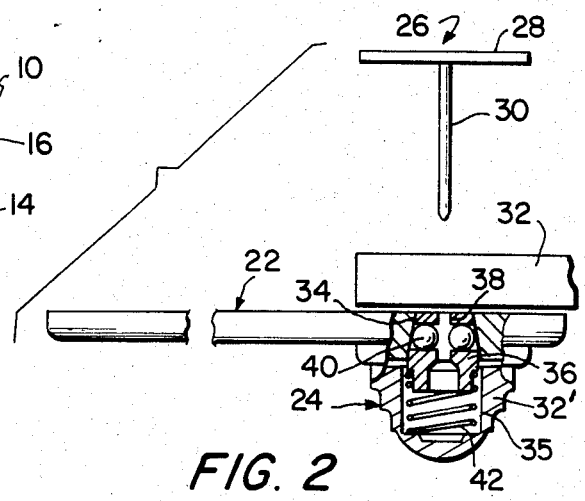
FIG. 2 is an elevational, part fragmentary view of the fastening clip.

Anti-theft device 12 is shown more clearly in FIG. 2 to comprise a tag section 22 which is attached to a lock section 24. An antenna (not shown) is mounted in the tag section for triggering an alarm circuit if the tag and lock assembly are surreptitiously removed from the premises without authorized removal of the tag from an article to be purchased at a checkout station. The operation of the antenna is not part of this invention and will not be discussed in detail herein.

In order to secure device 12 to an article, a pin generally indicated at 26 engages lock section 24. Pin 26 comprises a head 28 and a shank 30. Shank 30 passes through an article such as a piece of clothing or the like shown at 32 and is received in the lock section 24.

Lock section 24 comprises a generally elongated housing 32′ which has an opening 34 formed in its top to receive shank 30. A central bore 35 is formed in the housing and receives an insert 36 which is axially movable in bore 35. Insert 36 contains an opening 38 in its upper section to receive pin shank 30. Balls 40 are mounted within insert 36 and move radially inward against shank 30 in a manner to frictionally hold the shank within the insert. The insert is held against the upper portion of housing 32 by a spring 42 and the balls 40 are forced radially inward by the upper walls of bore 35 which curve inward. When insert 36 is moved downward against the force of spring 42, the balls can move radially outward to release shank 30 such that shank 30 can be removed from lock section 24. The operation of lock section 24 is set forth in greater detail in the aforementioned U.S. Pat. No. 4,012,813.

Figure 3:
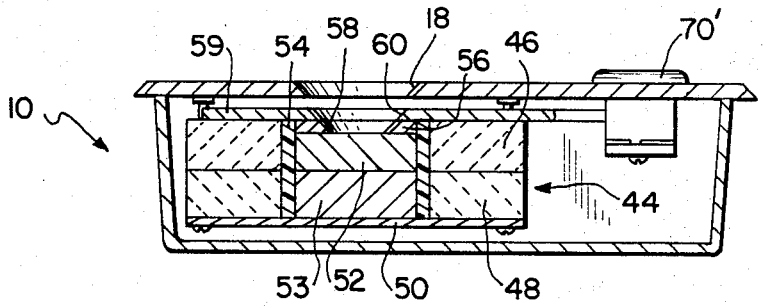
FIG. 3 is an elevational, sectional view of the secure release apparatus of the present invention.

FIG. 3 shows release apparatus 10 in greater detail. The release apparatus includes a magnetic assembly 44 which functions to pull insert 36 against the tension of spring 42 in bore 35 when the lock section 24 is inserted in opening 18. Magnet assembly 44 comprises a pair of annular ceramic magnets 46 and 48 which are mounted one on top of the other. A base plate 50 is connected to the lower annular magnet 48. Base plate 50 is a ferromagnetic material such as iron which provides a low reluctance path for the magnetic flux of the magnets. A pair of disk shaped magnets 52 and 53 are also mounted one on top of the other on plate 50. Magnets 52 and 53 are positioned inside of annular magnets 46 and 48 and separated from the annular magnets by a spacer 54. Magnets 52 and 53 are preferably rare earth magnets having their poles oriented oppositely to magnets 46 and 48. The top of disk magnet 52 is slightly below the top of the annular magnet 46 and a spacer 56 is mounted so as to fill this gap. Spacer 56 has a beveled hole 58 which aligns with beveled hole 18 in plate 16.

Magnets 46, 48, 52 and 53 have their poles oriented so that a magnetic circuit is completed from disk magnets 52 and 53 to the annular magents 46 and 48 through plate 50 and the air gap just below opening 18. In this manner, a very strong magnetic field is produced and, when lock section 24 is inserted in opening 18, the magnetic field operates on insert 36 to release pin 26.

The housing of the release apparatus is designed so that top plate 16 can be disposed almost flush with a checkout countertop or the like. As articles are purchased, the counter person can simply insert the lock section of each anti-theft device 10 into opening 18, remove pin 26, and bag the purchased article.

Figure 4:
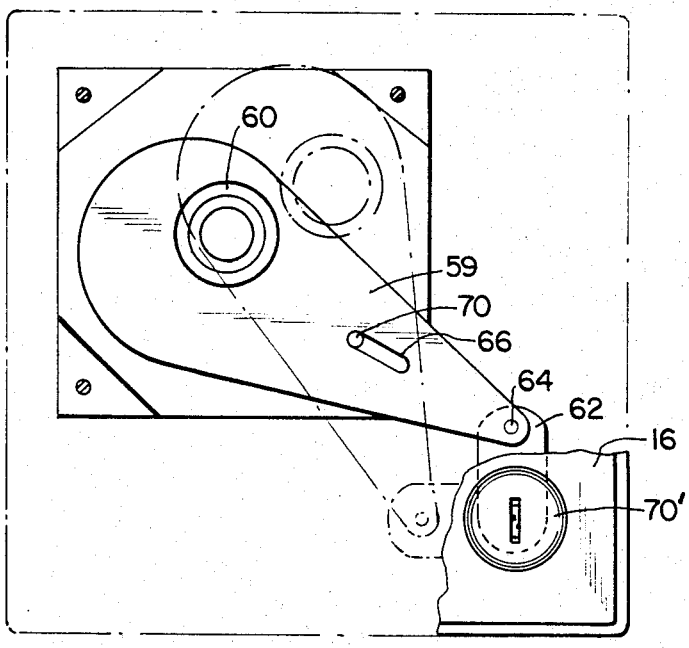
FIG. 4 is a top plan view of the release apparatus with the cover plate partly broken away.

FIGS. 3 and 4 show a secure locking arrangement which can be used to disable the release apparatus 10 when not in use. As discussed above, if release apparatus 10 is formed as part of a countertop or attached to a countertop, unauthorized personnel may remove anti-theft devices 12 in order to enable them to steal articles without detection. In order to avoid this circumstance, release apparatus 10 is provided with a movable cam plate 59 which is mounted above magnet assembly 44 but below top plate 16. Cam plate 59 is generally triangular in shape and contains an opening 60 which is tapered to correspond to opening 18 in top plate 16. Cam plate 58 slides on the top of magnet assembly 44 between a position shown in dash dot lines in FIG. 4 wherein a solid part of the cam plate is disposed directly beneath opening 18 and a position shown in solid lines wherein opening 60 is disposed beneath top plate opening 18. Accordingly, in the first position, the magnet assembly is blocked so that unauthorizeed personnel cannot insert lock portion 24 sufficiently far into opening 18 to cause insert 36 to enter the magnetic field produced by the magnet assembly. In the second position, the opening 60 aligns with opening 18 so that authorized personnel can remove anti-theft devices.

Movement of cam plate 59 is controlled by a lock arm 62 which is key operated from above top plate 16. Lock arm 62 swings through an arc of 90°. The end of lock arm 62 is pivotally connected at pivot point 64 to a corner of cam plate 59. A cam slot 66 is formed in cam plate 59 and receives a cam pin 70. Pin 70 is fixedly mounted to plate 50. When lock arm 62 is rotated, cam plate 59 moves outwardly as slot 66 slides along cam pin 70 and cam plate 59 swings through an arc sufficient to open or close off opening 18. As seen in FIGS. 3 and 4, lock arm 62 can be operated by a standard lock assemlby 70′ which is rotated by removable key.

In order to ensure that cam plate 59 slides easily along magnet assembly 44, the cam plate should be made out of a non-ferromagnetic material. Synthetic resin materials can be used or paramagnetic materials such as aluminum can be used. Top plate 16 can be made of either ferromagnetic material or non-ferromagnetic material. When the top plate is produced of ferromagnetic material, the lines of flux pass through the top plate and extend radially of opening 18. When the top plate is made of a non-ferromagnetic material, such as aluminum, the lines of flux extend more axially within the opening 16. Base member 14 is also preferably produced from a non-ferromagnetic material so as not to interfere with the operation of the magnet assembly. Base member 14 can be deleted from the assembly entirely if top plate 16 is mounted flush with the countertop. In this situation, an opening would be formed in the countertop and the countertop material would act as the base.

Figure 5:
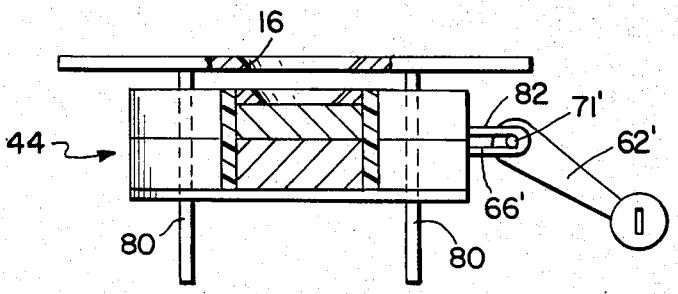
FIG. 5 is a diagrammatic representation showing an alternate structure for rendering the release apparatus inoperative.

FIG. 5 shows an alternate structure for rendering the release apparatus secure when not in use by authorized personnel. In FIG. 5, magnet assembly 44 is slidably mounted on guide studs 80. Magnet assembly 44 can move up and down on studs 80 thereby moving closer to or further away from opening 18. This movement is produced by a lock arm 62' which is mounted to a cam pin 71'. Pin 71' is received in a slot 66' which is formed in a collar 82 fixedly mounted to magnet assembly 44. Accordingly, as key lock 70 is rotated, lock arm 62 moves the magnet assembly from a position proximate to opening 16 to a position which is spaced from opening 16 by a considerable distance.

In operation, when the magnet assembly 44 is in the upper position, lock section 24 can be inserted far enough into opening 16 for the magnetic field to act on insert 36 thereby releasing pin 26. However, when the magnet assembly is lowered, the magnetic field is spaced from opening 16 by a distance which is greater than the depth to which lock section 24 can be inserted. Accordingly, the magnetic field has no influence on insert 36 and pin 26 will not be released.

Figure 6:
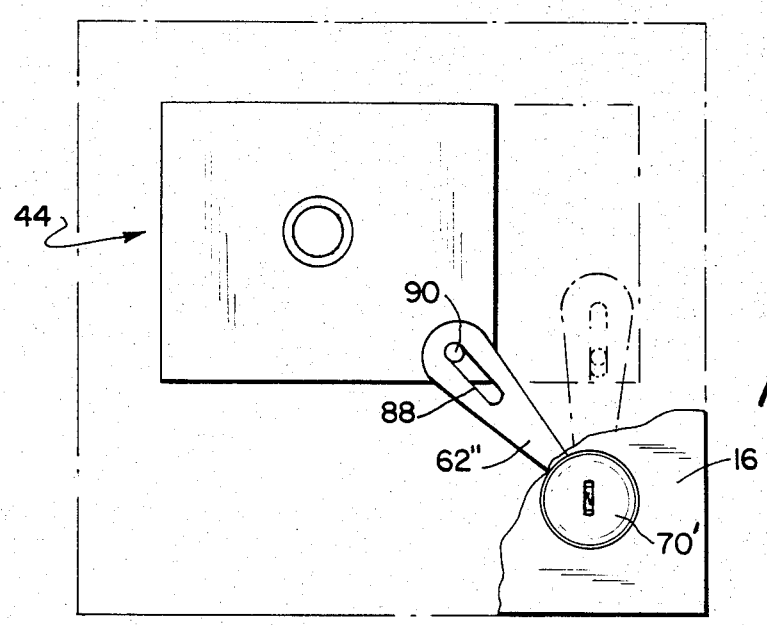
FIG. 6 is another alternate structure for rendering the release apparatus inoperative.

FIG. 6 shows yet another embodiment of the present invention wherein top plate 16 has been broken away to show magnet assembly 44. In this embodiment, magnet assembly 44 can move laterally so that opening 58 can be aligned with top plate opening 18 in the operative position or can be moved away from opening 18 when the release apparatus is not to be used. To effect this movement, lock 70' swings lock arm 62''. Arm 62'' contains a slot 88 in which a pin 90 rides. Pin 90 is fixed to magnet assembly 44. Magnet assembly 44 is positioned in a suitable slide so that when lock 24 is twisted, pin 90 will ride in slot 88 and draw magnet assembly across the top plate 16.

Figure 7:
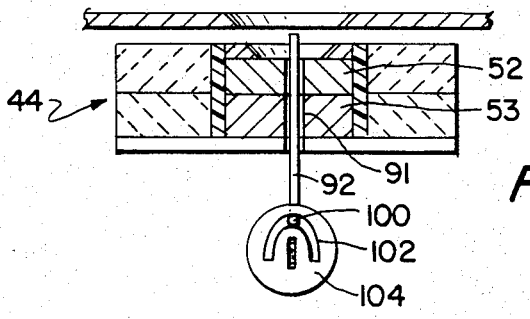
FIG. 7 is a further alternate structure for rendering the release apparatus inoperative.

A further embodiment of the present invention is shown in FIG. 7 wherein a pin 92 is disposed in a hole which is formed centrally of disk magnet 52. A cam pin 100 extends laterally of pin 92 and is received in a spiral slot 102 formed in a cam disk 104. Disk 104 is rotated by the lock so that cam pin 160 is either drawn downwardly toward the center of disk 104 or is moved upwardly toward the edge of disk 104. As pin 100 moves, it draws pin 92 with it thus moving the pin 92 up or down in opening 91. In the locked position, pin 92 is moved up by a distance sufficient to prohibit lock section 24 of anti-theft device 12 from being moved into the magnetic field of assembly 44. Clearly, in the unlocked position, pin 92 is simply drawn downwardly below the surface of magnet assembly 44 to render the apparatus operative.

Figure 8:
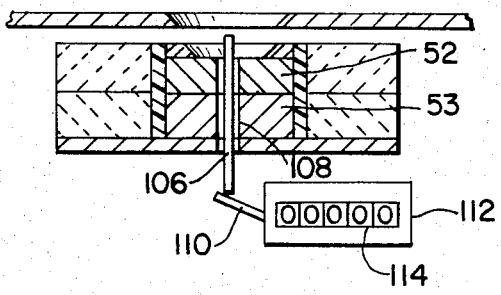
FIG. 8 shows a counter structure which may be used with any of the embodiments of the release apparatus.

To complement any of the previously discussed embodiments of the present invention, FIG. 8 shows a counter which can maintain a running total of the number of anti-theft devices removed. The counter mechanism includes a vertical shaft 106 which extends through an opening 108 in disk magnets 52 and 53. Shaft 106 rests on a spring loaded actuation lever 110 which operates counter mechanism 112. Counter 112 can either be a mechanical counter or lever 110 can be a switch lever with an electrical signal being passed to an electronic counter. In either event, the counter 112 produces a running count on display 114. Counter 112 has normal reset features which would be accessible only to authorized personnel. For example, if counter 112 were to be used only to detect unauthorized use of the release apparatus 10, the reset could be connected to lock 70 such that the counter is reset to 0 each time the release apparatus 10 is positioned in the inoperative position. Accordingly, for each unauthorized use of the device, counter 112 will advance by 1. Alternately, counter 112 can be used to keep a running total of all of the tags removed by the release apparatus. In this manner the count number present when the apparatus 10 is locked could be written down and compared with the number present when the apparatus is unlocked.

In each of the embodiments of the present invention it should be clearly understood that in the locked position, the magnetic field produced by magnet assembly 44 must be oriented such that it does not extend above top plate 16 sufficiently far to release lock assembly 24 before the lock assembly has been inserted into opening 18.

The foregoing description of the preferred embodiments was given for purposes of illustrating the present invention but is not deemed to limit the invention in any way. Clearly, numerous additions and other modifications can be made to the present invention without departing from the scope thereof as set forth in the appended claims.

What is claimed is:

1. A secure release apparatus for use with an anti-theft device, said anti-theft device comprising: a main body having a bore, a pin sized to fit within said bore, a gripping means in said main body for engaging and holding said pin, and disengagement means for disengaging said gripping means, said disengagement means including a member which is movable in response to an applied magnetic field, said secure release apparatus comprising:

a housing comprising a cover plate;

an access opening in said cover plate for receiving said main body;

a permanent magnet structure disposed below said cover plate, said permanent magnet structure producing a concentrated magnetic field sufficiently strong to move said disengagement means member to disengage said gripping means when said body is received in said access opening and said disengagement means member is disposed in said concentrated magnetic field; and tamper prevention means movable into a first position for preventing said main body from being inserted into said access opening in a manner to move said disengagement means member into said concentrated field, and movable into a second position for permitting said main body to be inserted into said concentrated field, said tamper prevention means comprising: a tamper prevention plate disposed between said cover plate and said permanent magnet structure; motion constraining means connected to said tamper prevention plate for permitting pivotal and limited longitudinal movement of said tamper prevention plate; and a rotatable locking device having a swingable lock arm pivotally connected to said tamper prevention plate wherein said lock arm may be swung by said locking device through a predetermined arc to apply force to said tamper prevention plate through said pivotal connection to move said tamper prevention plate through said pivotal and limited longitudinal movement into either said first position wherein said tamper prevention plate extends across said access opening or into said second position in which said access opening is unrestricted by said tamper prevention plate.

2. A secure release apparatus as set forth in claim 1, wherein said tamper prevention means is contained within said housing.

3. A secure release apparatus as set forth in claim 1, wherein said cover plate is a non-ferromagnetic material.

4. A secure release apparatus as set forth in claim 1, wherein said permanent magnet structure comprises an annular shaped magnet having a central opening aligned with said access opening, a disk shaped magnet received in the central opening of said annular shaped magnet, and a ferromagnetic plate mounting said magnets.

5. A secure release apparatus as set forth in claim 1 and further including means for counting the number of anti-theft devices disengaged by said secure release apparatus.

6. A secure release apparatus as set forth in claim 5, wherein said counter means comprises a shaft extending into said access opening, and an incremental counter position to be actuated by said shaft.

7. A secure release apparatus as set forth in claim 1, wherein said magnet assembly is spaced below said cover plate.

8. A secure release apparatus as set forth in claim 1, wherein said concentrated magnetic field of said magnet structure does not extend above said cover plate sufficiently to move said disengagement means member when said tamper prevention means is in said first position.

9. A secure release apparatus for use with an anti-theft device, said anti-theft device comprising: a main body having a bore, a pin sized to fit within said bore, a gripping means in said main body for engaging and holding said pin, and disengagement means for disengaging said gripping means, said disengagement means including a member which is movable in response to an applied magnetic field, said secure release apparatus comprising:

a housing comprising a cover plate;

an access opening in said cover plate for receiving said main body;

a permanent magnet structure disposed below said cover plate, said permanent magnet structure producing a concentrated magnetic field sufficiently strong to move said disengagement means member to disengage said gripping means when said body is received in said access opening and said disengagement means member is disposed in said concentrated magnetic field; and tamper prevention means movable into a first position for preventing said main body from being inserted into said access opening in a manner to move said disengagement means member into said concentrated field, and movable into a second position for permitting said main body to be inserted into said concentrated field, said tamper prevention means comprising means for moving said permanent magnet structure toward and away from said access opening, wherein said moving means comprises a linkage connected to said permanent magnet for moving said permanent magnet axially of said access opening.

10. A secure release apparatus for use with an anti-theft device, said anti-theft device comprising: a main body having a bore, a pin sized to fit within said bore, a gripping means in said main body for engaging and holding said pin, and disengagement means for disengaging said gripping means, said disengagement means including a member which is movable in response to an applied magnetic field, said secure release apparatus comprising:

a housing comprising a cover plate;

an access opening in said cover plate for receiving said main body;

a permanent magnet structure disposed below said cover plate, said permanent magnet structure producing a concentrated magnetic field sufficiently strong to move said disengagement means member to disengage said gripping means when said body is received in said access opening and said disengagement means member is disposed in said concentrated magnetic field; and tamper prevention means movable into a first position for preventing said main body from being inserted into said access opening in a manner to move said disengagement means member into said concentrated field, and movable into a second position for permitting said main body to be inserted into said concentrated field, said tamper prevention means comprising means for moving said permanent magnet structure toward and away from said access opening, wherein said moving means comprises a linkage connected to said permanent magnet structure for moving said permanent magnetic structure laterally of said access opening.

11. A secure release apparatus for use with an anti-theft device, said anti-theft device comprising: a main body having a bore, a pin sized to fit within said bore, a gripping means in said main body for engaging and holding said pin, and disengagement means for disengaging said gripping means, said disengagement means including a member which is movable in response to an applied magnetic field, said secure release apparatus comprising:

a housing comprising a cover plate;

an access opening in said cover plate for receiving said main body;

a permanent magnet structure disposed below said cover plate, said permanent magnet structure producing a concentrated magnetic field sufficiently strong to move said disengagement means member to disengage said gripping means when said body is received in said access opening and said disengagement means member is disposed in said concentrated magnetic field; and tamper prevention means movable into a first position for preventing said main body from being inserted into said access opening in a manner to move said disengagement means member into said concentrated field, and movable into a second position for permitting said main body to be inserted into said concentrated field, wherein said tamper prevention means comprises a pin extending from the bottom of said permanent magnet structure through said permanent magnet structure toward said access opening, and means for moving said pin toward and away from said access opening.

* * * * *